US009977375B2

(12) United States Patent
Sato

(10) Patent No.: US 9,977,375 B2
(45) Date of Patent: May 22, 2018

(54) IMAGE FORMING DEVICE

(71) Applicant: KYOCERA Document Solutions Inc., Osaka-shi (JP)

(72) Inventor: Takehiro Sato, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days. days.

(21) Appl. No.: 15/529,121

(22) PCT Filed: Mar. 31, 2016

(86) PCT No.: PCT/JP2016/060610
§ 371 (c)(1),
(2) Date: May 24, 2017

(87) PCT Pub. No.: WO2016/163292
PCT Pub. Date: Oct. 13, 2016

(65) Prior Publication Data

US 2018/0024472 A1 Jan. 25, 2018

(30) Foreign Application Priority Data

Apr. 6, 2015 (JP) ..... 2015-077613

(51) Int. Cl.
*G03G 15/16* (2006.01)
*G03G 21/16* (2006.01)

(52) U.S. Cl.
CPC ..... *G03G 15/1605* (2013.01); *G03G 15/1615* (2013.01); *G03G 21/168* (2013.01); *G03G 21/1633* (2013.01); *G03G 21/1647* (2013.01)

(58) Field of Classification Search
CPC ..... G03G 15/1605; G03G 15/161; G03G 15/1615; G03G 21/1647; G03G 21/1633; G03G 21/1638; G03G 21/168
See application file for complete search history.

(56) References Cited

U.S. PATENT DOCUMENTS 5,930,564 A * 7/1999 Ookaji ..... G03G 15/167 399/125
2008/0145084 A1* 6/2008 Toizumi ..... G03G 15/08 399/66

(Continued)

FOREIGN PATENT DOCUMENTS

JP 2005-091613 4/2005

*Primary Examiner* — Carla Therrien
(74) *Attorney, Agent, or Firm* — Gerald E. Hespos; Michael J. Porco; Matthew T. Hespos

(57) ABSTRACT

An image forming device (1) has an image carrier (331), a transfer member (35), a holding member (81) which holds the transfer member, a pressing member (83) which changes a position between a first position and a second position to make the transfer member contact and separate from the image carrier, a first moving member (325) and a second moving member (10P1) which are movable, and a first interlocking mechanism (33T) and a second interlocking mechanism (10Q). The first interlocking mechanism and the second interlocking mechanism press the pressing member to change a position of the pressing member in conjunction with the first moving member and the second moving member. The pressing member includes a first pressed portion (83P1) which is pressed by the first interlocking mechanism, and a second pressed portion (83P2) which is pressed by the second interlocking mechanism.

9 Claims, 16 Drawing Sheets

(56) References Cited

U.S. PATENT DOCUMENTS

| | | | | |
|---|---|---|---|---|
| 2010/0278557 | A1* | 11/2010 | Somemiya | G03G 21/1638 399/124 |
| 2012/0163863 | A1* | 6/2012 | Murashima | G03G 21/168 399/121 |
| 2015/0168879 | A1* | 6/2015 | Mori | G03G 15/1615 399/121 |

* cited by examiner

IMAGE FORMING DEVICE

TECHNICAL FIELD

The present invention relates to an image forming device which forms an image on a sheet.

BACKGROUND ART

An image forming device which forms an image on a sheet has been conventionally known. An image forming device includes a photosensitive drum, an intermediate transfer belt, a primary transfer roller, and a secondary transfer roller. A toner image carried on the photosensitive drum is transferred onto the intermediate transfer belt by the primary transfer roller. Further, the toner image on the intermediate transfer belt is transferred onto a sheet by the secondary transfer roller. JP 2005-91613 A discloses a mechanism which makes the primary transfer roller contact and separate from the photosensitive drum and a mechanism which makes the secondary transfer roller contact and separate from the intermediate transfer belt. Additionally, a technique to rotatably support a secondary transfer roller in an opening/closing unit which can be opened/closed to a main body of an image forming device is also known.

In the above-described image forming device, the contact/separation mechanism of the primary transfer roller and the contact/separation mechanism of the secondary transfer roller are each provided with a dedicated driving source. This causes upsizing or cost increase of an image forming device. Additionally, with a technique having a secondary transfer roller rotatably supported in an opening/closing unit, at opening/closing of the opening/closing unit, the secondary transfer roller and the intermediate transfer belt rub against with each other in some cases.

An object of the present invention is to provide an image forming device capable of separating a transfer member from an image carrier in conjunction with moving operation of a plurality of moving members without increasing the number of driving sources.

SUMMARY

An image forming device according to one aspect of the present invention is characterized by including an image carrier which carries a developer image; a transfer member in contact with the image carrier forms, together with the image carrier, a transfer nip portion through which a sheet passes, to transfer the developer image onto the sheet; a holding member which holds the transfer member; an urging member which urges the holding member toward the image carrier; a pressing member capable of changing a position between a first position at which the transfer member makes contact with the image carrier by an urging force of the urging member and a second position at which the holding member is pressed against the urging force of the urging member to separate the transfer member from the image carrier; a first moving member which is movable; a second moving member which is movable; a first interlocking mechanism which presses the pressing member in conjunction with the first moving member to change a position of the pressing member from the first position to the second position; and a second interlocking mechanism which presses the pressing member in conjunction with the second moving member to change a position of the pressing member from the first position to the second position, the pressing member including a first pressed portion which is pressed by the first interlocking mechanism, and a second pressed portion which is pressed by the second interlocking mechanism.

The present invention can provide an image forming device capable of separating a transfer member from an image carrier in conjunction with moving operation of a plurality of moving members without increasing the number of driving sources.

DESCRIPTION OF EMBODIMENTS

Figure 1:
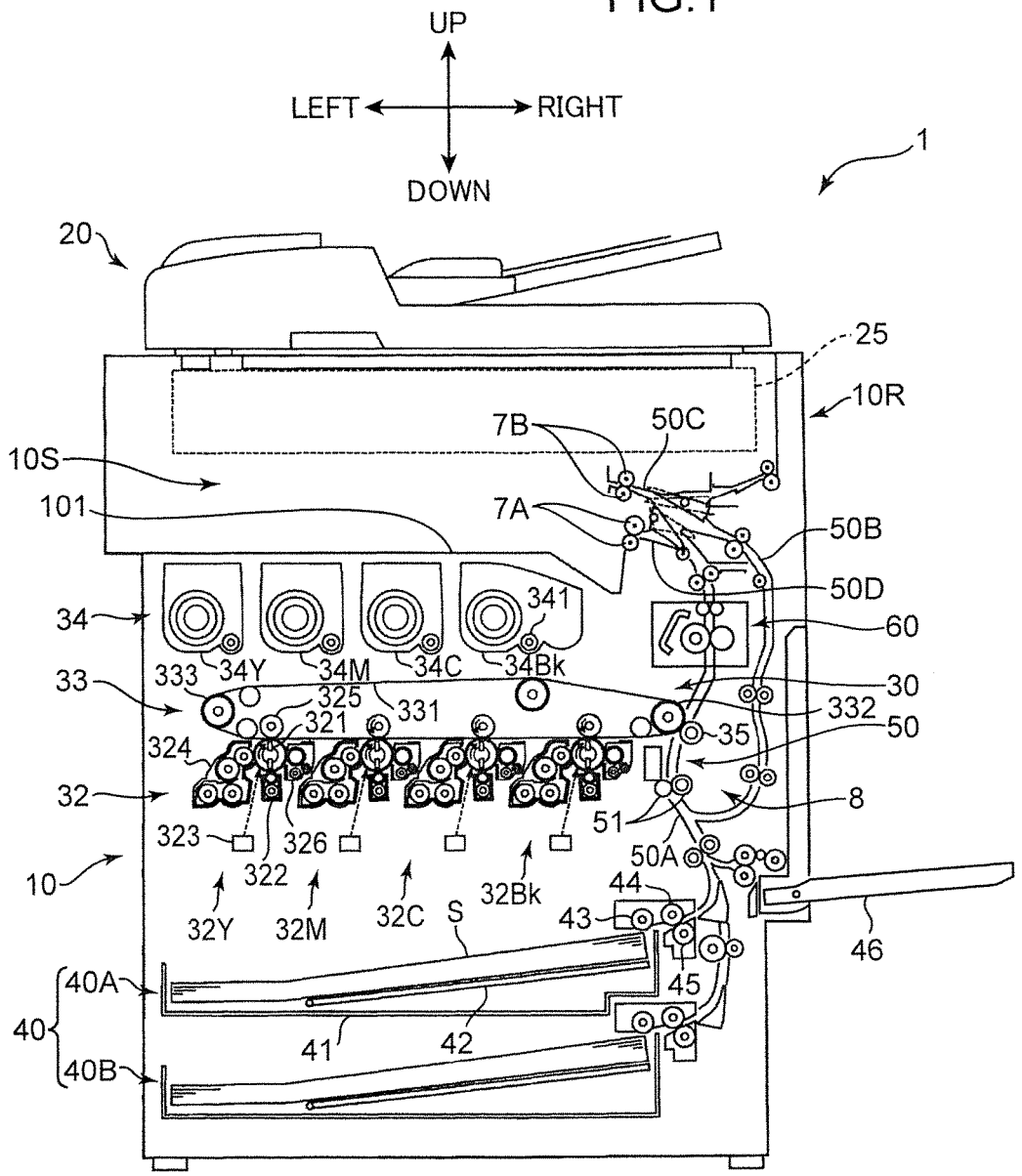
FIG. 1 is a sectional view showing an internal structure of an image forming device according to one embodiment of the present invention.

In the following, an embodiment of the present invention will be described in detail with reference to the drawings. FIG. 1 is a sectional view showing an internal structure of an image forming device 1 according to one embodiment of the present invention. Although as the image forming device 1, a multifunctional machine provided with a printer function and a copy function is illustrated here, the image forming device can be a printer, a copying machine, or a facsimile apparatus.

<Description of Image Forming Device>

The image forming device 1 includes a device main body 10 (casing) having a generally rectangular solid casing structure, and an automatic document feeder 20 arranged on the device main body 10. The device main body 10 houses a reading unit 25 which optically reads an original document image to be copied, an image forming portion 30 which forms a toner image on a sheet, a fixing portion 60 which fixes the toner image on a sheet, a sheet feeding portion 40 which stores a sheet to be transported to the image forming portion 30, and a transport path 50 which transports a sheet from the sheet feeding portion 40 or a sheet feeding tray 46 to a discharge space 10S via the image forming portion 30 and the fixing portion 60. A sheet S discharged to the discharge space 10S is loaded in a sheet discharge portion 101.

The automatic document feeder (ADF) 20 automatically feeds an original document sheet to be copied toward a predetermined original document reading position in the device main body 10. On the other hand, when a user places an original document sheet at a predetermined original document reading position by hand, the ADF 20 is opened upward. The reading unit 25 optically reads an image of an original document sheet automatically fed from the ADF 20 on an upper surface of the device main body 10 or an image of an original document sheet placed by hand.

The image forming portion 30, which is configured to generate a full-color toner image and transfer the same onto a sheet to form the image on the sheet, includes: an image forming unit 32 having four units 32Y, 32M, 32C, and 32Bk, which respectively form toner images of yellow (Y), magenta (M), cyan (C), and black (Bk), arranged in tandem; an intermediate transfer unit 33 arranged on and adjacent to the image forming unit 32; and a toner supply portion 34 arranged on the intermediate transfer unit 33.

Each of the image forming units 32Y, 32M, 32C, and 32Bk includes a photosensitive drum 321, and a charger 322, an exposure unit 323, a developing device 324, a primary transfer roller 325 (a first moving member, a stretching roller), and a cleaning device 326 which are arranged around the photosensitive drum 321.

The photosensitive drum 321 rotates around an axis thereof to have an electrostatic latent image formed on a surface thereof and carries a toner image (developer image) on the surface thereof. The charger 322 uniformly charges the surface of the photosensitive drum 321. The exposure unit 323, which has a laser light source and optical devices such as a mirror and a lens, irradiates a circumferential surface of the photosensitive drum 321 with a light based on image data of an original document image to form an electrostatic latent image.

The developing device 324 supplies a toner to the circumferential surface of the photosensitive drum 321 in order to develop an electrostatic latent image formed on the photosensitive drum 321. The primary transfer roller 325 is arranged to be opposed to the photosensitive drum 321 with an intermediate transfer belt 331 to be described later provided therebetween. The primary transfer roller 325 primarily transfers a toner image on the photosensitive drum 321 onto the intermediate transfer belt 331. The cleaning device 326 cleans the circumferential surface of the photosensitive drum 321 after toner image transfer.

The intermediate transfer unit 33 includes the intermediate transfer belt 331 (image carrier), a belt driving roller 332 (driving roller), and a belt driven roller 333. The intermediate transfer belt 331 is arranged to be opposed to a plurality of the photosensitive drums 321 and is driven to circulate. To an outer circumferential surface of the intermediate transfer belt 331, toner images (developer images) are transferred from the plurality of photosensitive drums 321 so as to laminate all of the toner images at the same position. The intermediate transfer belt 331 carries a toner image while rotating counterclockwise in FIG. 1.

The belt driving roller 332 is connected to a driving mechanism not shown. The belt driving roller 332 is in contact with an inner circumferential surface of the intermediate transfer belt 331 to cause the intermediate transfer belt 331 to circulate. The belt driven roller 333 stretches the intermediate transfer belt 331 at a side opposite to the belt driving roller 332 so as to circulate. The plurality of primary transfer rollers 325 corresponding to the respective colors also functions, at a position different from that of the belt driving roller 332, as a stretching roller in contact with the inner circumferential surface of the intermediate transfer belt 331.

Opposed to a circumferential surface of the belt driving roller 332, a secondary transfer roller 35 (transfer member) is arranged. The secondary transfer roller 35 is rotated by a driving mechanism not shown to transfer a toner image onto a sheet. In particular, the intermediate transfer belt 331 with the inner circumference supported by the belt driving roller 332 and the secondary transfer roller 35 form a nip portion serving as a secondary transfer portion (transfer nip portion) which transfers a full-color toner image superimposed on the intermediate transfer belt 331 onto a sheet when the sheet passes through the secondary transfer portion.

The toner supply portion 34 includes a yellow toner container 34Y, a magenta toner container 34M, a cyan toner container 34C, and a black toner container 34Bk, and supplies the developing devices 324 of the respective image forming units 32Y, 32M, 32C, and 32Bk with toner of the respective colors from discharge screws 341 via supply paths whose figure is omitted.

The sheet feeding portion 40 includes two-staged sheet feeding cassettes 40A and 40B which house the sheet S to be subjected to image forming processing. These sheet feeding cassettes 40A and 40B can be drawn frontward from a front of the device main body 10.

The sheet feeding cassette 40A (40B) includes a sheet housing portion 41 which houses a bundle of sheets composed of stacked sheets S, and a lift plate 42 which lifts up the bundle of sheets to be fed. Above a right end side of the sheet feeding cassette 40A (40B), a pick-up roller 43, and a pair of rollers including a sheet feeding roller 44 and a retard roller 45 are arranged. Driving the pick-up roller 43 and the sheet feeding roller 44 dispenses an uppermost sheet S of the bundle of sheets in the sheet feeding cassette 40A one by one to be fed into an upstream end of the transport path 50.

The transport path 50 includes a main transport path 50A which transports the sheet S from the sheet feeding portion 40 to an output port of the fixing portion 60 via the image forming portion 30, a double-sided transport path 50B which, in a case of printing on both sides of the sheet S, returns a one-side printed sheet to the image forming portion 30, and an upper discharge path 50C and a lower discharge path 50D for directing the sheet S from a downstream end of the main transport path 50A toward the discharge space 10S. The sheet S transported through the upper discharge path 50C and the lower discharge path 50D is discharged to the discharge space 10S by a pair of upper discharge rollers 7B and a pair of lower discharge rollers 7A.

On an upper stream side of the main transport path 50A than a secondary transfer portion 35A, a pair of resist rollers 51 is arranged. The sheet S is stopped once at the pair of resist rollers 51 in a stopped state to perform skew correction. Thereafter, driving the pair of resist rollers 51 to rotate by a driving motor (illustration omitted) at predetermined timing for image transfer results in feeding out the sheet S to the secondary transfer roller 35.

The fixing portion 60 is an induction heating type fixing device which performs fixing processing of fixing a toner image to the sheet S. The fixing portion 60 has a fixing nip portion. Passing of the sheet S through the fixing nip portion results in fixing, to the sheet, a toner image transferred onto the sheet S.

Figure 7:
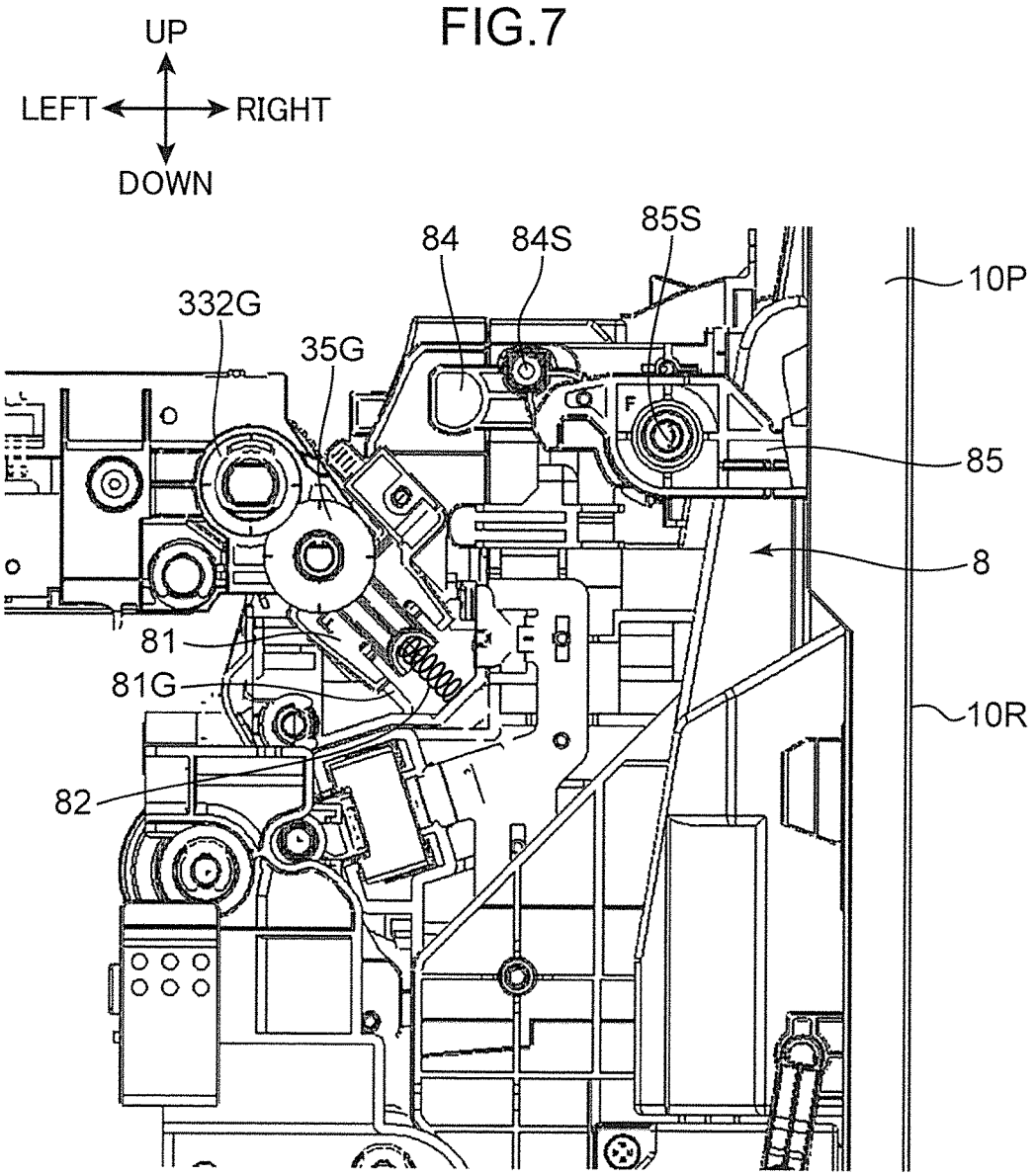
FIG. 7 is a front view of the surroundings of the transfer member within the image forming device according to one embodiment of the present invention.

Further, the image forming device 1 includes a transport unit 8 (FIG. 1, FIG. 8) and an opening/closing cover 10P (FIG. 7). The opening/closing cover 10P configures a part of a right wall 10R of the device main body 10. The opening/closing cover 10P includes a supporting point portion not shown in a lower end portion thereof. The opening/closing cover 10P is configured to be rotatable centered around the supporting point portion with respect to the device main body 10. Rotation of the opening/closing cover 10P opens the double-sided transport path 50B to the outside of the device main body 10. On the other hand, the transport unit 8 also includes a supporting point portion not shown in a lower end portion thereof. The transport unit 8 is configured to be rotatable centered around the supporting point portion with respect to the device main body 10 so as to follow opening operation of the opening/closing cover 10P. Rotation of the transport unit 8 further opens the main transport path 50A to the outside of the device main body 10.

Figure 2:
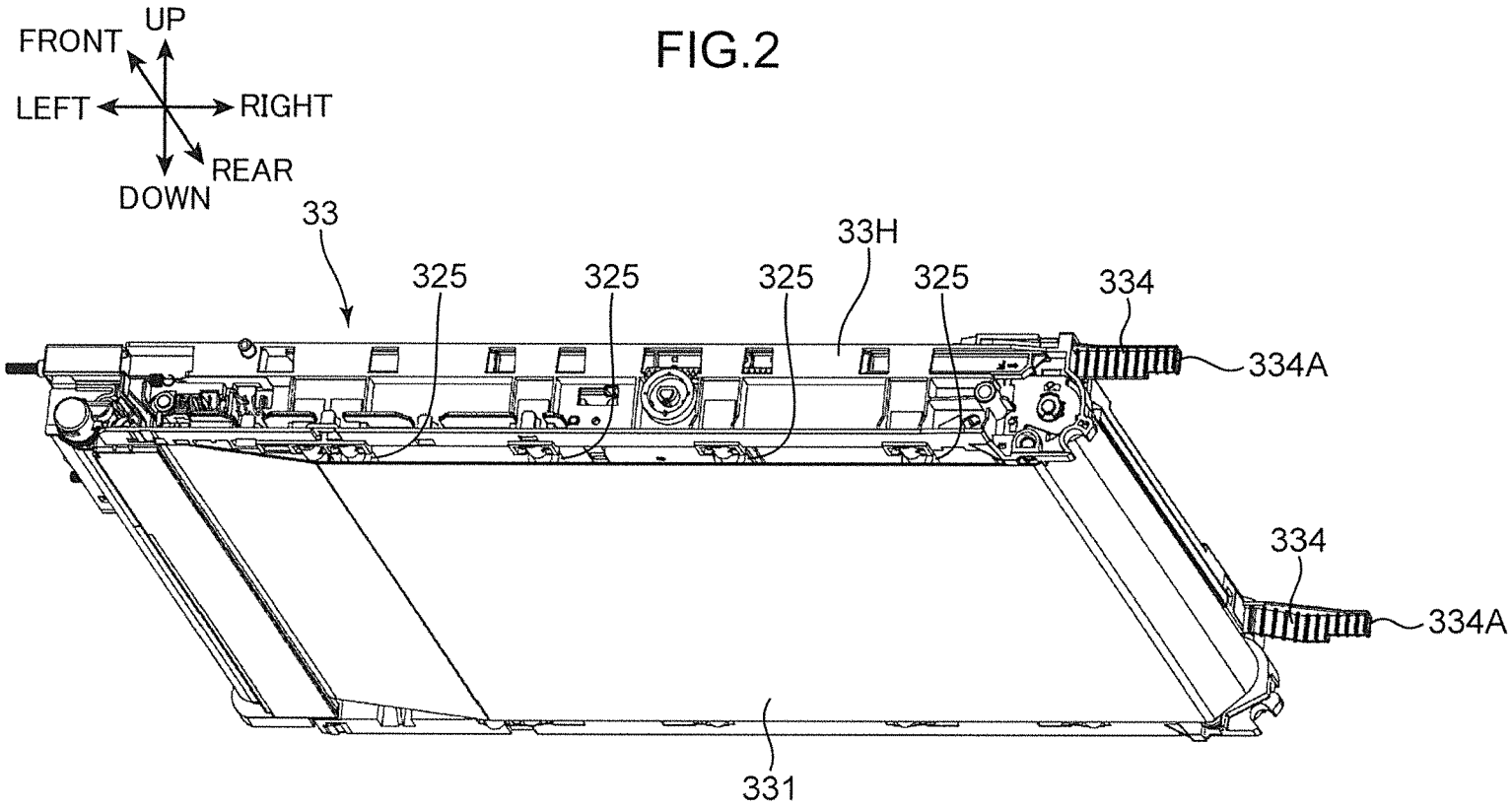
FIG. 2 is a perspective view of an intermediate transfer unit of the image forming device according to one embodiment of the present invention.
Figure 3:
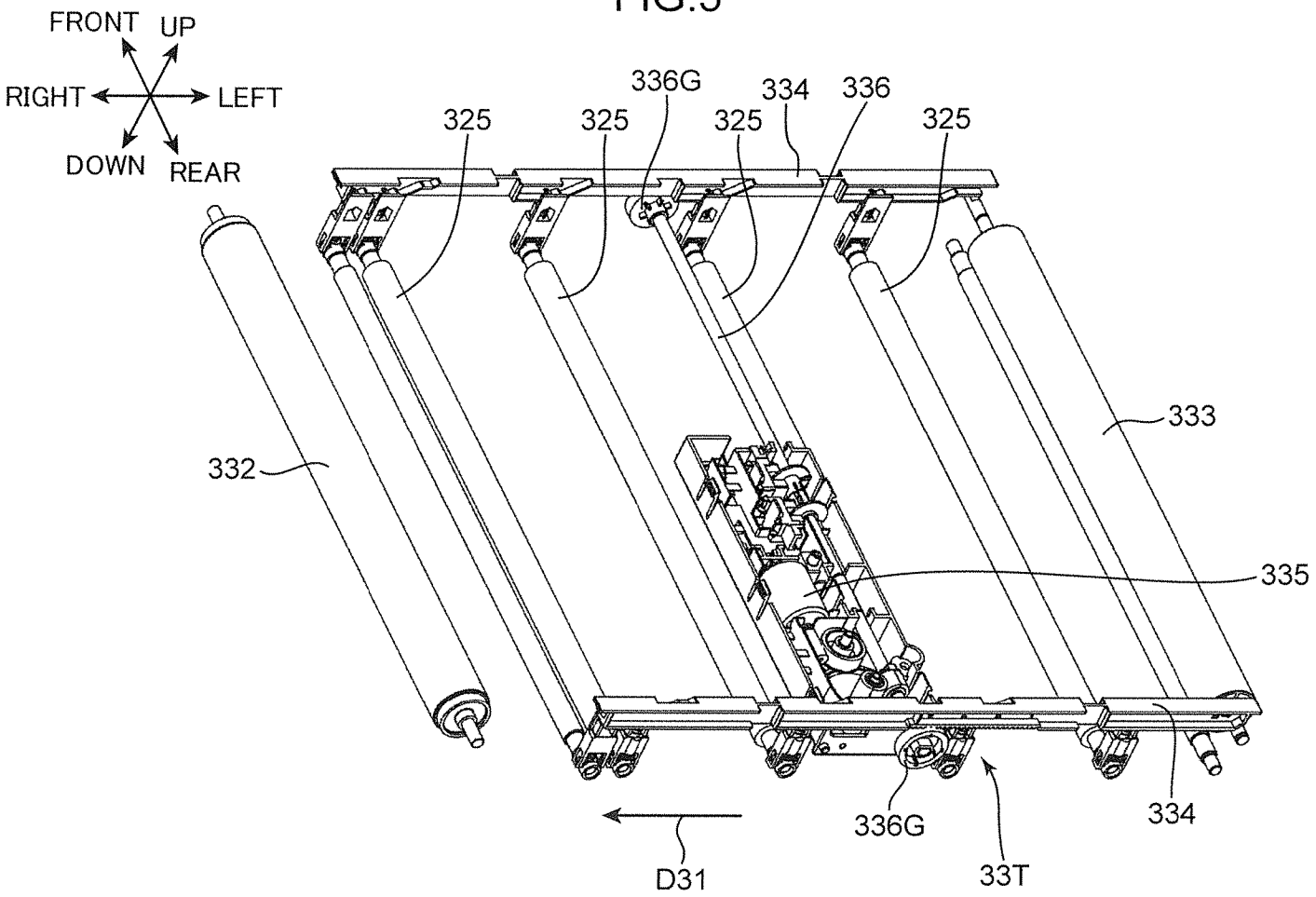
FIG. 3 is a perspective view showing an internal structure of the intermediate transfer unit of the image forming device according to one embodiment of the present invention.
Figure 4A:
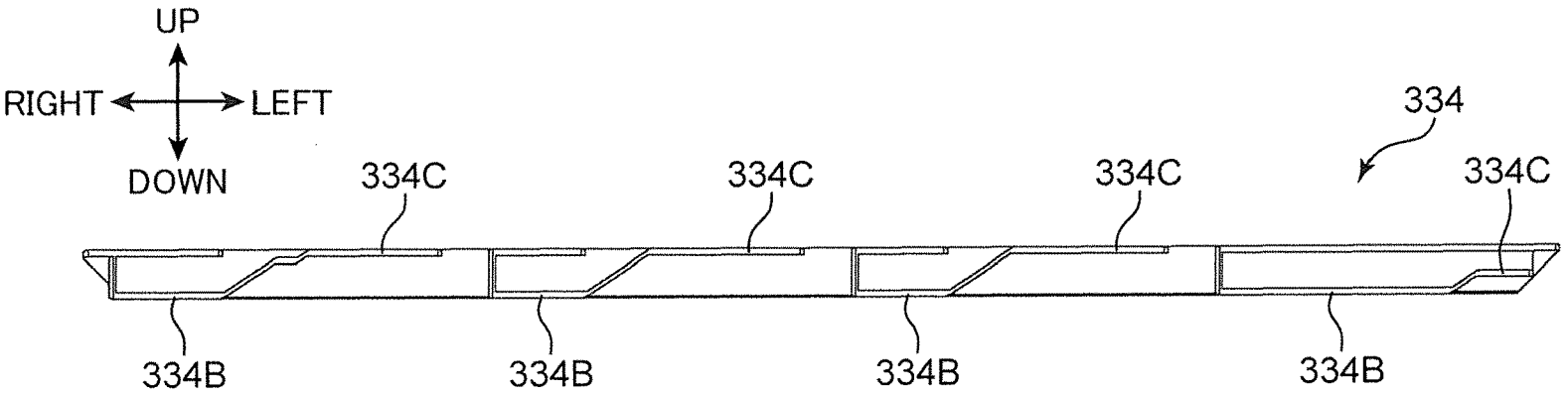
FIG. 4A is a rear view of a rack of the intermediate transfer unit according to one embodiment of the present invention.
Figure 4B:
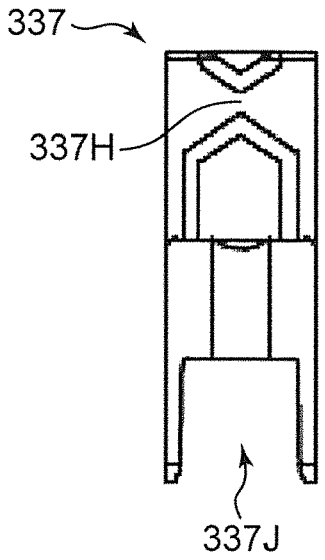
FIG. 4B is a front view of a supporting member of the intermediate transfer unit according to one embodiment of the present invention.
Figure 4C:
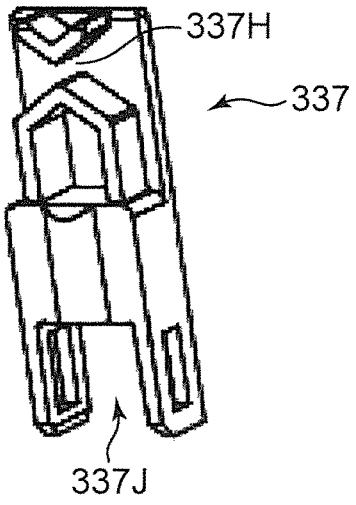
FIG. 4C is a perspective view of the supporting member of the intermediate transfer unit according to one embodiment of the present invention.
Figure 5:
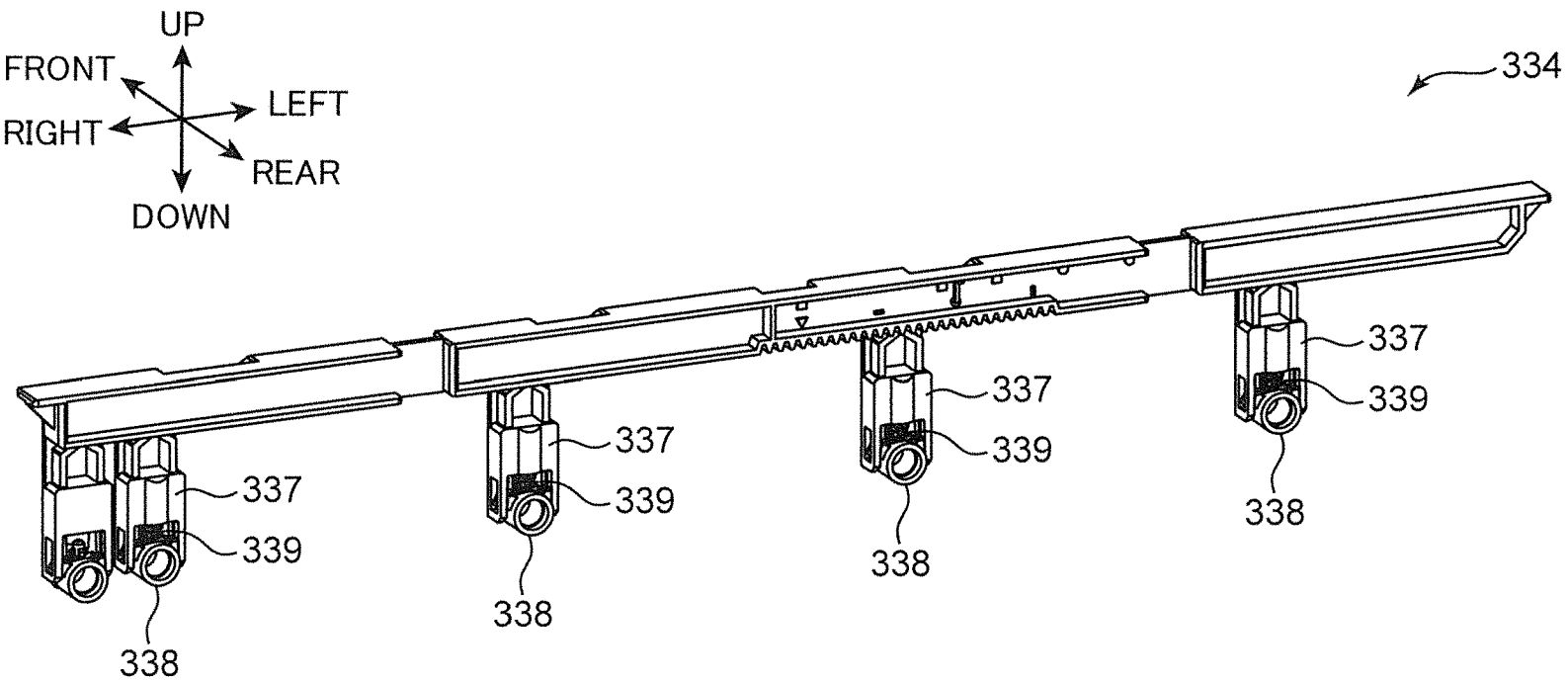
FIG. 5 is a perspective view showing a state where a plurality of the supporting members is engaged with the rack of the intermediate transfer unit according to one embodiment of the present invention.

Next, the intermediate transfer unit 33 according to the present embodiment will be detailed. FIG. 2 is a perspective view of the intermediate transfer unit 33. FIG. 3 is a perspective view showing an internal structure of the intermediate transfer unit 33. FIG. 4A is a rear view of a roller contact/separation rack 334 of the intermediate transfer unit 33. FIG. 4B and FIG. 4C are respectively a front view and a perspective view of a bearing holder 337 of the intermediate transfer unit 33. FIG. 5 is a perspective view showing a state where a plurality of the bearing holders 337 engages with the roller contact/separation rack 334.

The intermediate transfer unit 33 includes a unit housing 3311, and a roller contact/separation mechanism 33T (the first interlocking mechanism) (FIG. 3). As compared with FIG. 2, illustration of the unit housing 3311 and the intermediate transfer belt 331 is omitted in FIG. 3. The unit housing 3311 is a casing part of the intermediate transfer unit 33 and has a flat box-shape. The unit housing 3311 rotatably supports the above-described plurality of primary transfer rollers 325, belt driving roller 332 and belt driven roller 333.

The roller contact/separation mechanism 33T is provided with a contact/separation function of making the primary transfer roller 325 be in contact with or separating the same from the photosensitive drum 321. Specifically, the roller contact/separation mechanism 33T causes the primary transfer rollers 325 of the respective colors to move between a first position at which the primary transfer roller 325 presses the intermediate transfer belt 331 to the photosensitive drum 321 and a second position at which the primary transfer roller 325 is separated from the photosensitive drum 321. The roller contact/separation mechanism 33T includes the roller contact/separation rack 334 (rack), a driving mechanism 335, a transmission shaft 336, the bearing holder 337 (supporting member), a bearing 338, and a roller spring 339.

The roller contact/separation racks 334 are members arranged as a pair with an interval in a front-rear direction and extending in a left-right direction. Each of the roller contact/separation racks 334 is movably supported in the unit housing 3311. The pair of roller contact/separation racks 334 supports both end portions of the plurality of primary transfer rollers 325. Then, the roller contact/separation racks 334 are configured to be movable in a direction linking axes of the plurality of primary transfer rollers 325 (the left-right direction). With reference to FIG. 4A, the roller contact/separation rack 334 includes first rails 334B and second rails 334C so as to correspond to the primary transfer rollers 325 of the respective colors. The first rails 334B and the second rails 334C are projecting pieces which project from the roller contact/separation rack 334 toward the outer side of the intermediate transfer unit 33. In FIG. 5, the first rail 334B and the second rail 334C are positioned at a rear side (front side) of the roller contact/separation rack 334 and therefore do not appear. With reference to FIG. 4A, the first rail 334B extends in the left-right direction in a lower end portion of the roller contact/separation rack 334. Additionally, the second rail 334C extends in the left-right direction in an upper end portion of the roller contact/separation rack 334 and at a position more leftward and upward than the first rail 334B. Further, the first rail 334B and the second rail 334C are connected by a slope ascending leftward. The bearing holder 337 engages with the first rail 334B and the second rail 334C.

The driving mechanism 335 is arranged within the unit housing 3311. The driving mechanism 335 is a unit including a motor, and a plurality of gears. The driving mechanism 335 generates a driving force which moves the roller contact/separation rack 334. The transmission shaft 336 is arranged adjacent to the driving mechanism 335 within the unit housing 3311. Additionally, the transmission shaft 336 extends in the front-rear direction so as to bridge the pair of roller contact/separation racks 334. The transmission shaft 336 is connected to the gear of the driving mechanism 335. In both end portions of the transmission shaft 336, transmission gears 336G are provided (FIG. 3). The transmission gear 336G is a pinion gear which transmits a driving force to the roller contact/separation rack 334. A driving force generated by the driving mechanism 335 is transmitted from the transmission shaft 336 to the pair of roller contact/separation racks 334. As a result, the roller contact/separation racks 334 move in the left-right direction.

The bearing holder 337 (FIG. 4B, FIG. 4C) supports the end portion of the primary transfer roller 325. In an upper end portion of the bearing holder 337, a gap 33711 is arranged which is formed between a pair of triangular projecting pieces. Into the gap 33711, the first rail 334B or the second rail 334C of the above-described roller contact/separation rack 334 is inserted. Additionally, in a lower end portion of the bearing holder 337, a housing portion 337J is formed for rotatably supporting the primary transfer roller 325. With reference to FIG. 5, the bearing 338 is arranged in the housing portion 337J of the bearing holder 337. In a tubular inner part of the bearing 338, a rotation shaft of the primary transfer roller 325 is inserted. The roller spring 339 is a spring member compressed between an inner wall portion on an upper side of the bearing holder 337 and the bearing 338. The roller spring 339 urges the primary transfer roller 325 toward the photosensitive drum 321.

The above-described first rail 334B regulates the bearing holder 337 such that the primary transfer roller 325 is arranged at the first position. Additionally, the second rail 334C is arranged at an interval from the first rail 334B in a moving direction of the roller contact/separation rack 334 to regulate the bearing holder 337 such that the primary transfer roller 325 is arranged at the second position.

Further, the roller contact/separation rack 334 of the intermediate transfer unit 33 includes a rack pressing portion 334A (FIG. 2). The rack pressing portion 334A is arranged at a front end portion of the roller contact/separation rack 334 in the moving direction (right direction) so as to be able to press a separating lever 83 which will be described later. In FIG. 3, illustration of the rack pressing portion 334A is omitted.

In FIG. 3, the bearing holder 337 corresponding to the primary transfer roller 325 of each color engages with the first rail 334B. Therefore, the primary transfer roller 325 is arranged at the first position of being in contact with the photosensitive drum 321 with the intermediate transfer belt 331 provided therebetween, thereby forming a primary transfer nip portion of each color. On the other hand, in a state shown in FIG. 3, when the motor of the driving mechanism 335 is rotated forward, the roller contact/separation rack 334 moves to a direction indicated by an arrow D31 in FIG. 3. As a result, the bearing holder 337 engages with the second rail 334C. On this occasion, upward movement of the bearing holder 337 results in arranging the primary transfer roller 325 at the second position. Then, a tension (tensile force) applied to the intermediate transfer belt 331 is weakened. When the primary transfer roller 325 of each color again comes into contact with the photosensitive drum 321, the motor of the driving mechanism 335 is reversely rotated, so that the roller contact/separation rack 334 is moved to a direction opposite to the arrow D31 in FIG. 3.

Figure 6:
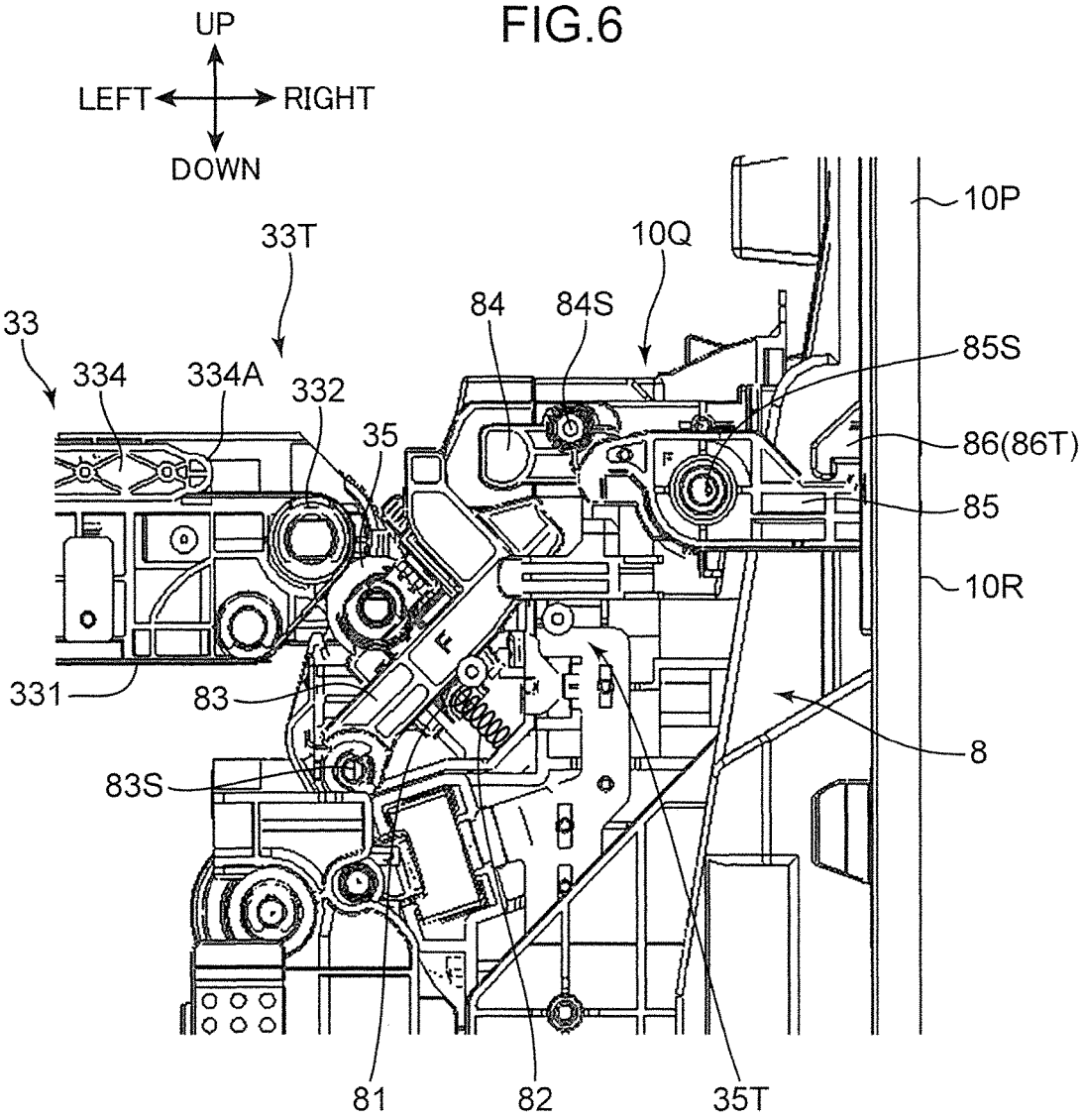
FIG. 6 is a front view of surroundings of a transfer member within the image forming device according to one embodiment of the present invention.
Figure 8:
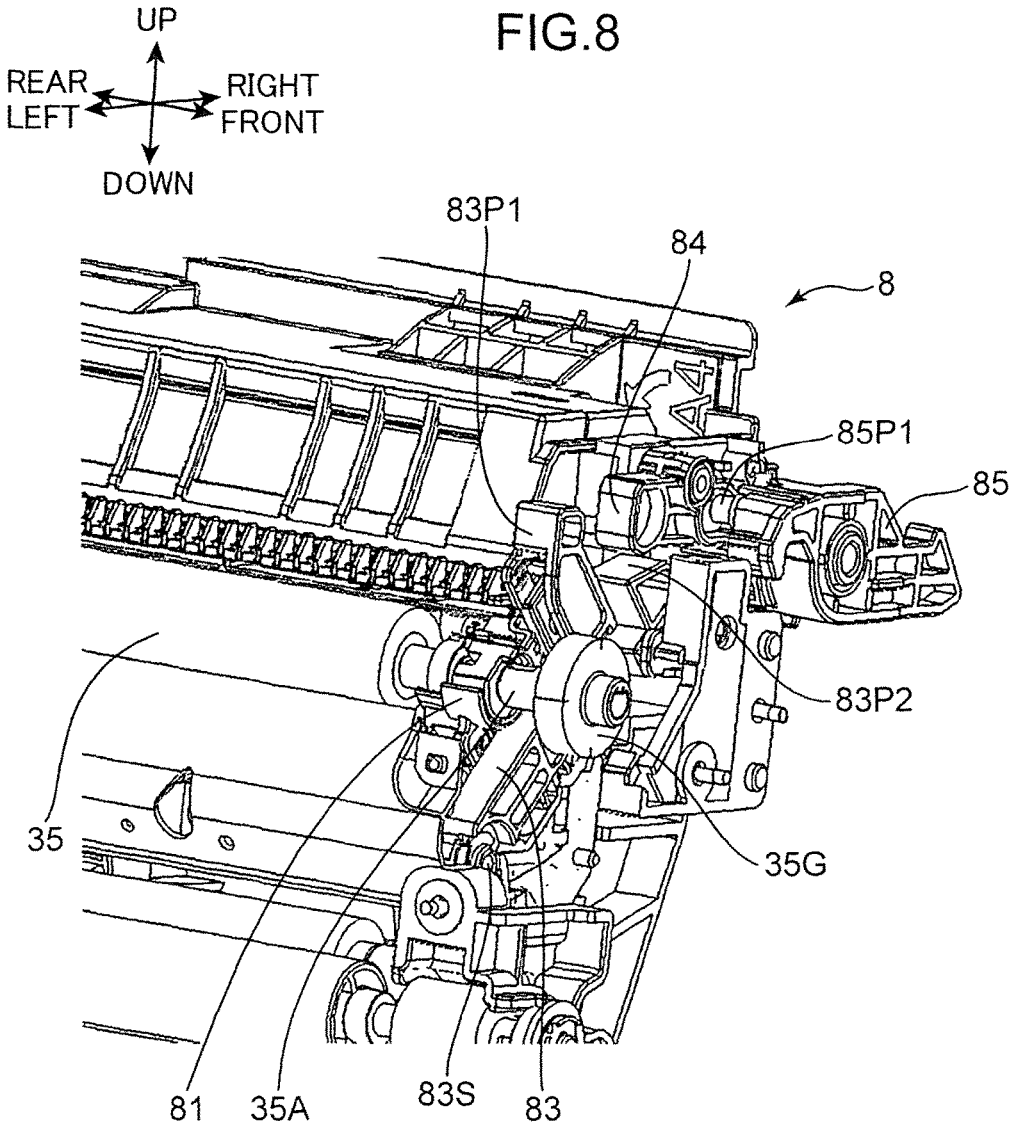
FIG. 8 is a perspective view of the surroundings of the transfer member within the image forming device according to one embodiment of the present invention.

FIG. 6 and FIG. 7 are front views of surroundings of the secondary transfer roller 35 within the image forming device 1 according to the present embodiment. In FIG. 7, for describing a structure of the surroundings of the secondary transfer roller 35, illustration of the separating lever 83 to be described later is omitted as compared with FIG. 6. FIG. 8 is a perspective view of the surroundings of the secondary transfer roller 35 within the image forming device 1.

The image forming device 1 further includes a bush 81 (holding member), a pressing spring 82 (urging member), the separating lever 83 (pressing member), and a separation interlocking mechanism 35T.

Figure 9A:
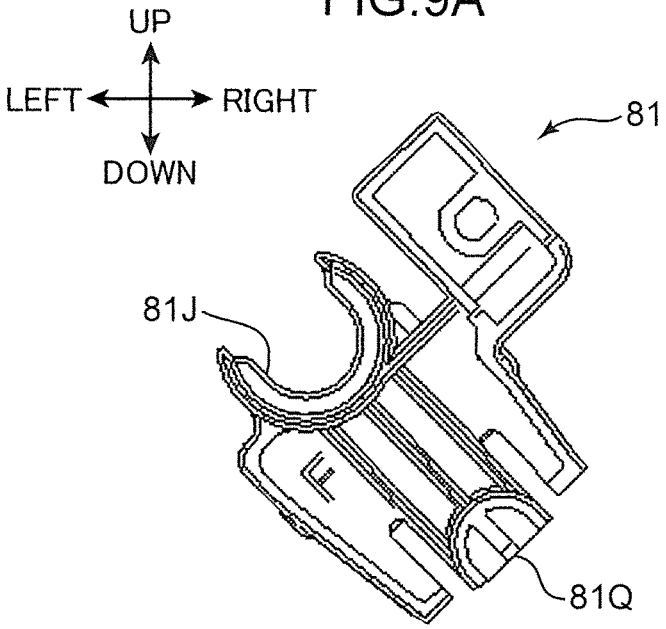
FIG. 9A is a front view of a holding member of the image forming device according to one embodiment of the present invention.
Figure 9B:
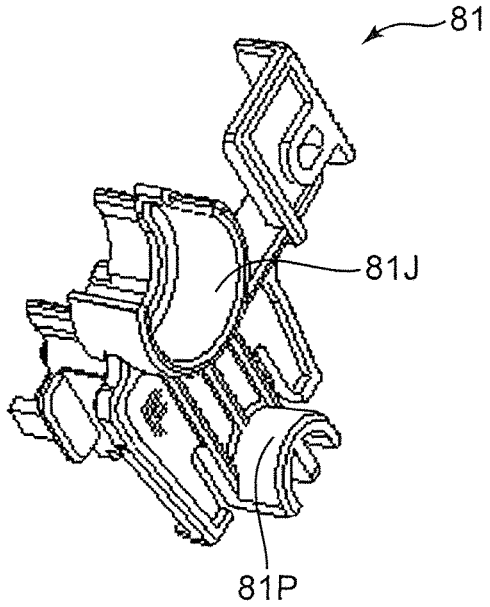
FIG. 9B is a perspective view of the holding member of the image forming device according to one embodiment of the present invention.

FIG. 9A and FIG. 9B are respectively a front view and a perspective view of the bush 81 according to the present embodiment. The bush 81 rotatably supports the secondary transfer roller 35. The bushes 81 are arranged in pair in a front end portion and a rear end portion of the transport unit 8. The bush 81 is configured to be movable along a direction toward the belt driving roller 332 by a bush guide 81G (FIG. 7) provided in the transport unit 8.

With reference to FIG. 9A and FIG. 9B, the bush 81 includes a bush bearing portion 81J (pivoting portion), a bush pressed portion 81P (pressed portion for separating), and a spring engaging portion 81Q (urged portion). The bush bearing portion 81J rotatably supports the secondary transfer roller shaft 35A of the secondary transfer roller 35 (FIG. 8) via a ball bearing not shown. As shown in FIG. 8, to a front end portion of the secondary transfer roller shaft 35A of the secondary transfer roller 35, a secondary transfer roller gear 35G is fixed for transmitting a rotation driving force to the secondary transfer roller 35 (FIG. 7). The secondary transfer roller gear 35G is engaged with a belt driving roller gear 332G for transmitting a rotation driving force to the belt driving roller 332. As a result, the belt driving roller 332 and the secondary transfer roller 35 are allowed to rotate in synchronization with each other.

The spring engaging portion 81Q is arranged in a lower end portion of the bush 81. With the spring engaging portion 81Q, one end of the pressing spring 82 is engaged. The spring engaging portion 81Q is urged upward and leftward by the pressing spring 82. The bush pressed portion 81P is arranged between the bush bearing portion 81J and the spring engaging portion 81Q. The bush pressed portion 81P has an arch-shape with a protrusion protruding toward the bush bearing portion 81J. The bush pressed portion 81P is pressed by a lever pressing portion 83P3 to be described later of the separating lever 83 toward a direction in which the secondary transfer roller 35 is separated from the intermediate transfer belt 331 (the belt driving roller 332).

The pressing spring 82 is a spring member arranged to be compressed between the bush 81 and a wall surface of the transport unit 8. The pressing spring 82 urges the bush 81 toward the intermediate transfer belt 331.

Figure 10A:
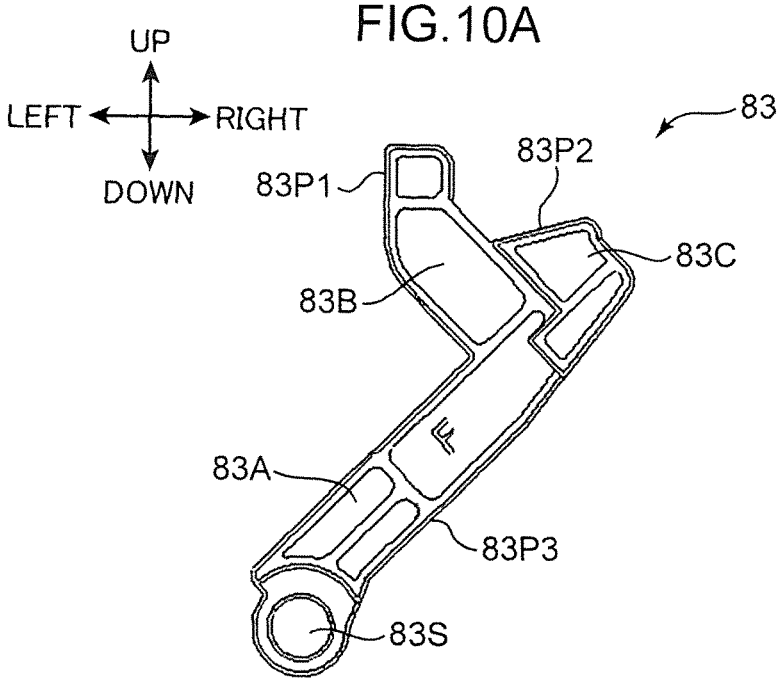
FIG. 10A is a front view of a pressing member of the image forming device according to one embodiment of the present invention.
Figure 10B:
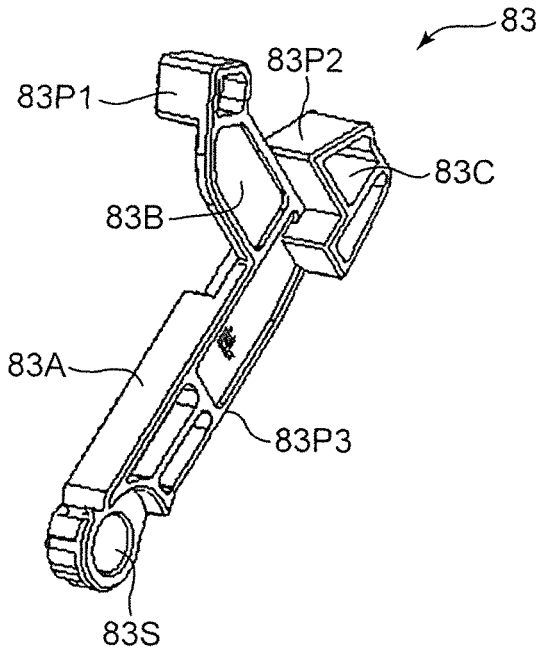
FIG. 10B is a perspective view of the pressing member of the image forming device according to one embodiment of the present invention.

FIG. 10A and FIG. 10B are respectively a front view and a perspective view of the separating lever 83 according to the present embodiment. The separating lever 83 is a lever member supported by the transport unit 8 so as to be rocked. With reference to FIG. 10A, the separating lever 83 has a shape with a curved front end in a front view. The separating lever 83 includes a lever supporting point portion 83S (supporting point portion), a lever main body 83A, a first front end portion 83B, and a second front end portion 83C. The lever main body 83A is a main body part of the separating lever 83. The lever main body 83A extends from lower left to upper right. The lever supporting point portion 83S is a hole portion opened to a lower end portion of the lever main body 83A. In the lever supporting point portion 83S, a shaft portion not shown which projects from the transport unit 8 is inserted. As a result, the separating lever 83 is allowed to rock around the lever supporting point portion 83S.

The first front end portion 83B is arranged in an upper end portion (front end portion) of the lever main body 83A. The first front end portion 83B extends from lower right to upper left. Additionally, in an upper end portion of the first front end portion 83B, a lever first pressed portion 83P1 (first pressed portion) is arranged. The lever first pressed portion 83P1 is a pressed surface pressed by the rack pressing portion 334A of the roller contact/separation rack 334 of the above-described roller contact/separation mechanism 33T. The second front end portion 83C is a generally trapezoid box-shaped part in a front view, which is arranged in a connection part between the lever main body 83A and the first front end portion 83B. In an upper surface portion of the second front end portion 83C, a lever second pressed portion 83P2 (second pressed portion) is formed. The lever second pressed portion 83P2 is a pressed surface which is pressed by a first link 84 of the cover interlocking mechanism 10Q to be described later.

Further, the lever main body 83A includes the lever pressing portion 83P3 (pressing portion). The lever pressing portion 83P3 is arranged on a lower side surface of the lever main body 83A, between the lever supporting point portion 83S, and the lever first pressed portion 83P1 and the lever second pressed portion 83P2. The lever pressing portion 83P3 has a function of pressing the bush pressed portion 81P of the above-described bush 81.

With reference to FIG. 8, the separating lever 83 is arranged below the secondary transfer roller shaft 35A between the bush 81 and the secondary transfer roller gear 35G of the secondary transfer roller 35 in the front-rear direction (an axial direction of the secondary transfer roller 35). Additionally, the separating lever 83 is fitted in between the bush bearing portion 81J of the bush 81 and the bush pressed portion 81P (FIG. 9B). As a result, the lever pressing portion 83P3 (FIG. 10A, FIG. 10B) is positioned immediately above the bush pressed portion 81P (FIG. 9B).

Figure 13:
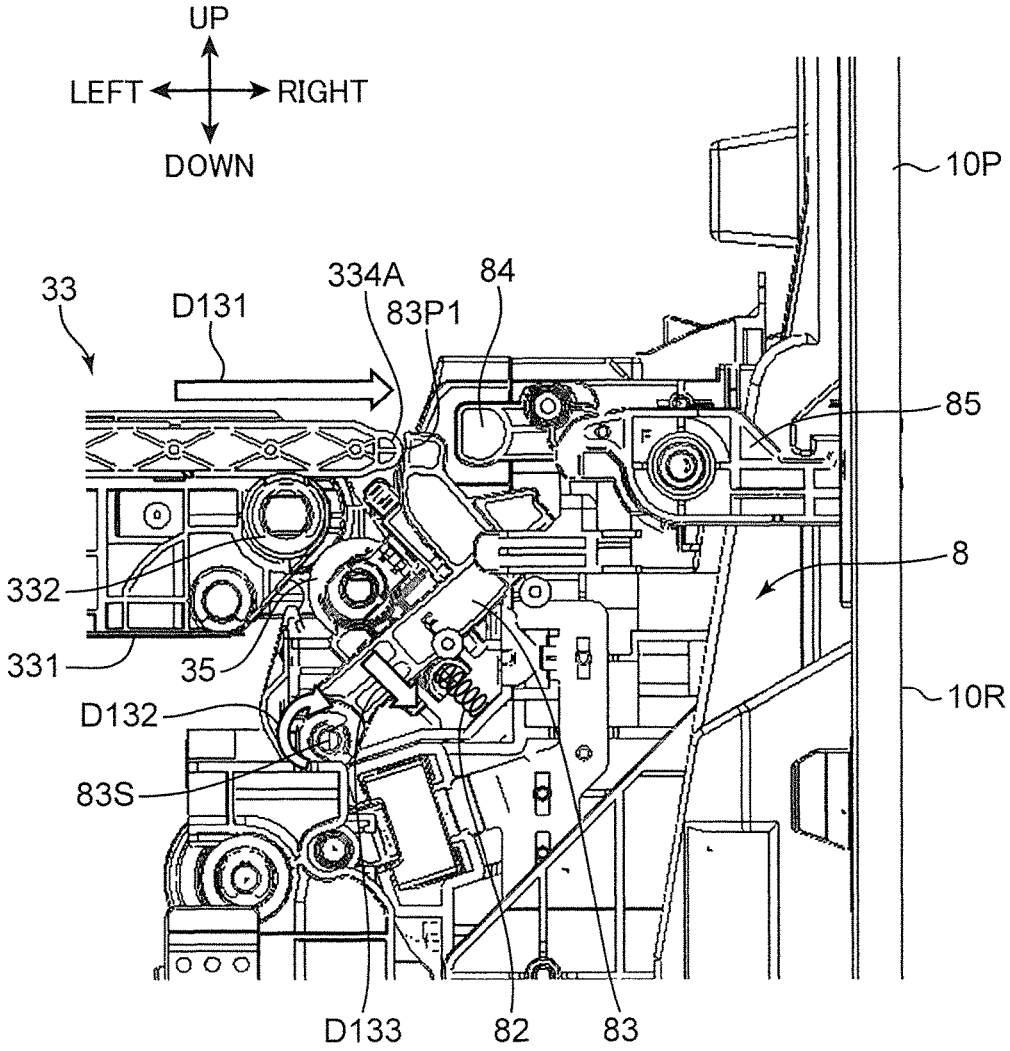
FIG. 13 is a front view showing how a first interlocking mechanism presses the pressing member within the image forming device according to one embodiment of the present invention.

Along with rocking around the lever supporting point portion 83S of the separating lever 83, the separating lever 83 changes a position between the first position (FIG. 6) and the second position (FIG. 13). In the first position, the separating lever 83 allows the secondary transfer roller 35 to be in contact with the intermediate transfer belt 331 by an urging force of the pressing spring 82. By contrast, in the second position, the separating lever 83 presses the bush 81 against the urging force of the pressing spring 82 to separate the secondary transfer roller 35 from the intermediate transfer belt 331.

The separation interlocking mechanism 35T (FIG. 6) has a function of separating the secondary transfer roller 35 from the belt driving roller 332. In particular, in the present embodiment, the separation interlocking mechanism 35T includes no dedicated motor (driving source) for separating the secondary transfer roller 35. The separation interlocking mechanism 35T uses a driving force following moving operation of the primary transfer roller 325 and moving operation of a grasping portion 10P1, which is to be described later, to separate the secondary transfer roller 35. The above-described roller contact/separation mechanism 33T (first interlocking mechanism) configures a part of the separation interlocking mechanism 35T. In conjunction with moving operation of the primary transfer roller 325 (contact/separation operation with/from the photosensitive drum 321), the roller contact/separation mechanism 33T presses the separating lever 83 to change the position of the separating lever 83 from the first position to the second position. Further, the separation interlocking mechanism 35T includes the cover interlocking mechanism 10Q (second interlocking mechanism) (FIG. 6).

Figure 14:
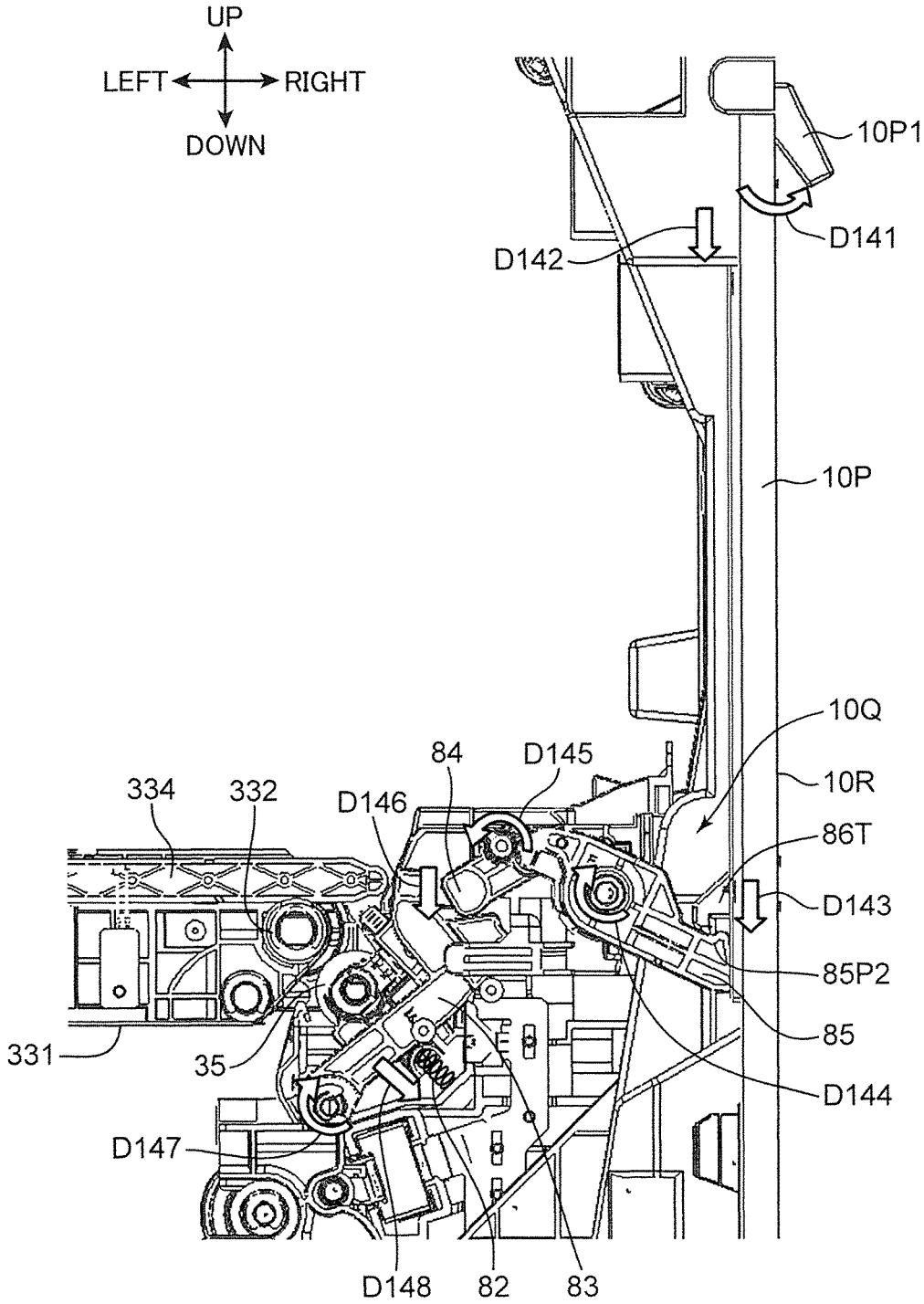
FIG. 14 is a front view showing how the second interlocking mechanism presses the pressing member within the image forming device according to one embodiment of the present invention.

The opening/closing cover 10P includes the grasping portion 10P1 (the second moving member, the grasping lever) (FIG. 14). The grasping portion 10P1 is supported at an upper end side of the opening/closing cover 10P so as to be rocked. The grasping portion 10P1 is exposed outside the opening/closing cover 10P (right wall 10R). In opening operation of the opening/closing cover 10P by a user of the image forming device 1, the grasping portion 10P1 is grasped to be rocked by the user. In conjunction with moving operation (rocking operation) of the grasping portion 10P1, the cover interlocking mechanism 10Q presses the separating lever 83 to change a position of the separating lever 83 from the first position to the second position.

Figure 11A:
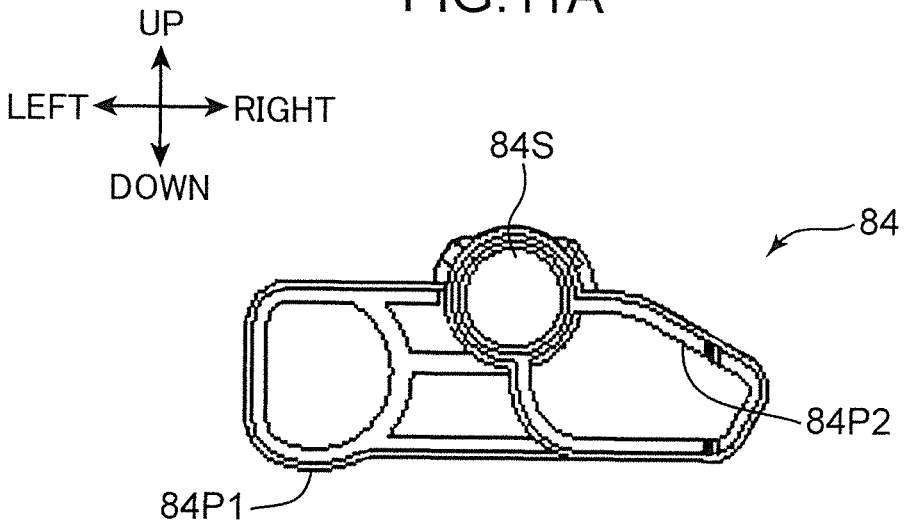
FIG. 11A is a front view of a first link of a second interlocking mechanism in the image forming device according to one embodiment of the present invention.
Figure 11B:
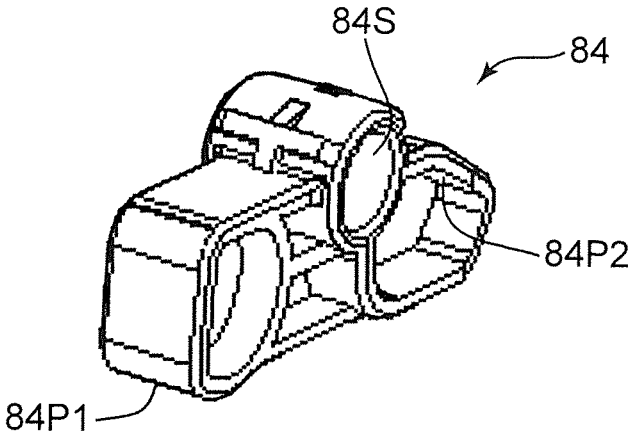
FIG. 11B is a perspective view of the first link of the second interlocking mechanism in the image forming device according to one embodiment of the present invention.
Figure 12A:
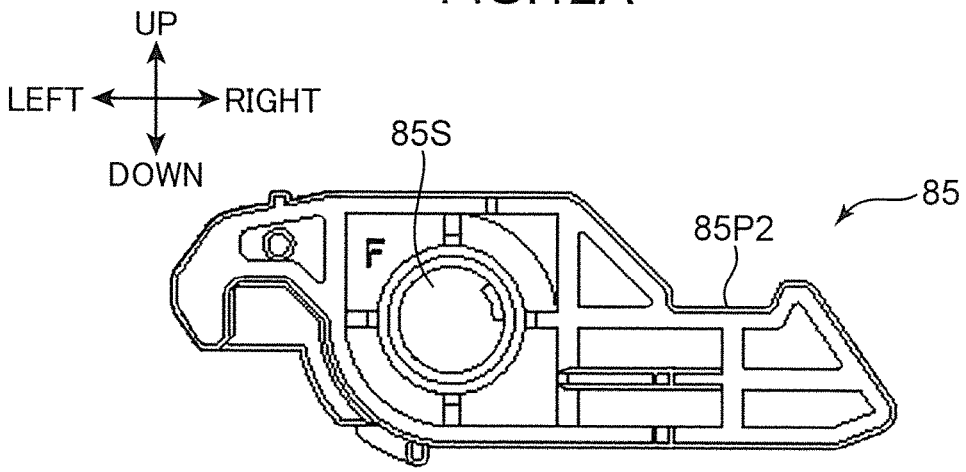
FIG. 12A is a front view of a second link of the second interlocking mechanism in the image forming device according to one embodiment of the present invention.
Figure 12B:
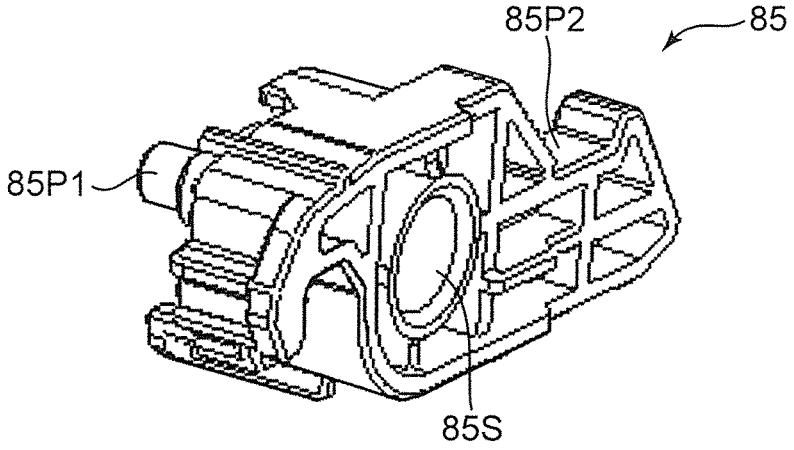
FIG. 12B is a perspective view of the second link of the second interlocking mechanism in the image forming device according to one embodiment of the present invention.

The cover interlocking mechanism 10Q includes the first link 84, a second link 85, and a lever link 86. FIG. 11A and FIG. 11B are respectively a front view and a perspective view of the first link 84 of the cover interlocking mechanism 10Q. FIG. 12A and FIG. 12B are respectively a front view and a perspective view of the second link 85 of the cover interlocking mechanism 10Q. FIG. 13 is a front view showing how the rack pressing portion 334A of the roller contact/separation mechanism 33T presses the separating lever 83 within the image forming device 1 according to the present embodiment. FIG. 14 is a front view showing how the cover interlocking mechanism 10Q presses the separating lever 83 within the image forming device 1 according to the present embodiment.

The first link 84 is rotatably supported on the upper right of the separating lever 83 in the transport unit 8 (FIG. 13). The first link 84 is a member extending in the left-right direction. The first link 84 includes a first link supporting point portion 84S, a first link pressing portion 84P1, and a first link pressed portion 84P2 (FIG. 11A, FIG. 11B). The first link supporting point portion 84S is a hole portion formed at the center in the left-right direction of the first link 84 and on an upper end side of the first link 84 so as to extend in the front-rear direction (a direction orthogonal to the sheet of FIG. 11A). In the first link supporting point portion 84S, the shaft portion not shown which projects from the transport unit 8 is inserted. As a result, the first link 84 is allowed to rotate around the first link supporting point portion 84S. The first link pressing portion 84P1 is a lower surface portion on a left end side of the first link 84. The first link pressing portion 84P1 has a function of pressing the lever second pressed portion 83P2 of the above-described separating lever 83 (FIG. 10A, FIG. 10B). The first link 84 includes a recessed portion formed by recessing a right side wall surface more backward than the first link supporting point portion 84S. The first link pressed portion 84P2 is an inner wall surface of the first link 84 formed by the recessed portion. The first link pressed portion 84P2 is pressed by a pressing pin 85P1 to be described later of the second link 85.

The second link 85 is rotatably supported, between the first link 84 and the opening/closing cover 10P, in the transport unit 8 as shown in FIG. 13. As shown in FIG. 8, the second link 85 is arranged forward of the first link 84. The second link 85 includes a second link supporting point portion 85S, the pressing pin 85P1, and a second link pressed portion 85P2. The second link supporting point portion 85S is arranged at a position slightly leftward from the center in the left-right direction of the second link 85. The second link supporting point portion 85S is a hole portion extending through in the front-rear direction (a direction orthogonal to the sheet of FIG. 12A) in the second link 85. In the second link supporting point portion 85S, the shaft portion not shown which projects from the transport unit 8 is inserted. As a result, the second link 85 is allowed to rotate around the second link supporting point portion 85S.

The pressing pin 85P1 is a pin provided at the left side of the second link supporting point portion 85S so as to project backward from a side surface at a rear side of the second link 85. The pressing pin 85P1 is inserted into the right side recessed portion of the first link 84. The pressing pin 85P1 has a function of pressing the first link pressed portion 84P2. The second link pressed portion 85P2 is an upper surface portion of a hook part formed at the right side of the second link supporting point portion 85S. The second link pressed portion 85P2 is pressed by the lever link 86.

The lever link 86 (FIG. 6, FIG. 14) is disposed so as to extend in an up-down direction within the opening/closing cover 10P. An upper end portion of the lever link 86 is connected to the grasping portion 10P1. Additionally, in a lower end portion of the lever link 86, a lever hook 86T is arranged (FIG. 14). The lever hook 86T is exposed to the inside of the device main body 10 of the image forming device 1 (FIG. 1) and is arranged to be opposed to the second link pressed portion 85P2 of the second link 85. During the opening operation of the opening/closing cover 10P, when the grasping portion 10P1 is grasped, the lever link 86 is moved downward.

Next, detailed description will be made of how in the present embodiment, the secondary transfer roller 35 is separated from the intermediate transfer belt 331 (the belt driving roller 332) in conjunction with separating operation of the primary transfer roller 325. When in the image forming device 1, image forming operation ends, a tension (tensile force) of the intermediate transfer belt 331 is desirably weakened. This suppresses the intermediate transfer belt 331 to have plastic deformation (flexure or a habit of winding) as a result. In the present embodiment, as described above, movement of the roller contact/separation rack 334 by a driving force of the driving mechanism 335 causes the primary transfer roller 325 to move from the first position to the second position and separate from the photosensitive drum 321.

With reference to FIG. 13, when the roller contact/separation rack 334 moves rightward, the rack pressing portion 334A presses the lever first pressed portion 83P1 of the separating lever 83 rightward (arrow D131). As a result, the separating lever 83 rotates around the lever supporting point portion 83S (arrow D132). Along with the rotation of the separating lever 83, the lever pressing portion 83P3 of the separating lever 83 (FIG. 10A) presses the bush pressed portion 81P of the pressing spring 82 (FIG. 9B) (arrow D133). As a result, the bush 81 (FIG. 8) moves to a lower right side against an urging force of the pressing spring 82, so that the secondary transfer roller 35 is separated from the intermediate transfer belt 331.

Thus, in the present embodiment, in conjunction with separating operation of the primary transfer roller 325, the secondary transfer roller 35 is separated from the intermediate transfer belt 331. Accordingly, in addition to plastic deformation of the intermediate transfer unit 33, generation of hysteresis on a circumferential surface of the secondary transfer roller 35 due to plastic deformation or a nip pressure can be prevented. On this occasion, by the roller contact/separation mechanism 33T and the separating lever 83, the primary transfer roller 325 and the secondary transfer roller 35 are separated simultaneously. As a result, no dedicated driving source is required for each separating operation and therefore reduction in a space and cost-down of the image forming device 1 can be realized.

Next, detailed description will be made of how the secondary transfer roller 35 is separated from the intermediate transfer belt 331 (the belt driving roller 332) in conjunction with opening operation of the opening/closing cover 10P and the transport unit 8 in the present embodiment.

When the main transport path 50A or the double-sided transport path 50B of the image forming device 1 is clogged with the sheet S, a user opens the opening/closing cover 10P or the transport unit 8 to expose the main transport path 50A or the double-sided transport path 50B to the outside of the device main body 10. This enables removal of the sheet S as a result. In the present embodiment, as shown in FIG. 6, the secondary transfer roller 35 is positioned below and at the right side (on the side of the opening/closing cover 10P) of the belt driving roller 332. Then, as a result of rotation thereof with a supporting point portion arranged on the lower end side as a supporting point, each of the opening/closing cover 10P and the transport unit 8 is opened to the device main body 10. At rotation of the transport unit 8 with the above supporting point portion as a supporting point, when the secondary transfer roller 35 remains in contact with the belt driving roller 332 across the intermediate transfer belt 331, the secondary transfer roller 35 is moved rightward and upward from the state shown in FIG. 6 while being strongly rubbed against the intermediate transfer belt 331. As a result, a surface of the intermediate transfer belt 331 has scratches caused by friction, thereby brining about a defective image.

In the present embodiment, in order to solve such a problem, separating operation of the secondary transfer roller 35 is realized in conjunction with opening operation of the opening/closing cover 10P and the transport unit 8. Specifically, with reference to FIG. 14, when a user grasps the grasping portion 10P1, the grasping portion 10P1 is rocked as indicated by an arrow D141. As a result, the lever link 86 (FIG. 6) inside the opening/closing cover 10P moves downward as indicated by an arrow D142. Then, the lever hook 86T of the lever link 86 pushes down the second link pressed portion 85P2 of the second link 85 (an arrow D143). As a result, the second link 85 rotates with the second link supporting point portion 85S (FIG. 6) as a supporting point (an arrow D144). Along with the rotation of the second link 85, the pressing pin 85P1 (FIG. 12B) pushes the first link pressed portion 84P2 of the first link 84 upward (FIG. 11B). As a result, the first link 84 rotates around the first link supporting point portion 84S (FIG. 6) (an arrow D145). Along with the rotation of the first link 84, the first link pressing portion 84P1 (FIG. 11A, FIG. 11B) pushes down the lever second pressed portion 83P2 of the separating lever 83 (FIG. 10A, FIG. 10B) (an arrow D146). As a result, the separating lever 83 rotates around the lever supporting point portion 83S (an arrow D147). Along with the rotation of the separating lever 83, the lever pressing portion 83P3 of the separating lever 83 (FIG. 10A) presses the bush pressed portion 81P of the pressing spring 82 (FIG. 9B) (an arrow D148). Then, the bush 81 (FIG. 8) moves to a lower right side against an urging force of the pressing spring 82, so that the secondary transfer roller 35 is separated from the intermediate transfer belt 331.

Thus, in the present embodiment, in conjunction with user's grasping operation at the time of grasping the grasping portion 10P1, the secondary transfer roller 35 is separated from the intermediate transfer belt 331. Therefore, when the opening/closing cover 10P is opened, rubbing of the secondary transfer roller 35 with the belt driving roller 332 can be suppressed. Additionally, since the secondary transfer roller 35 is separated by using a user's grasping force, no dedicated driving source is required for separating operation of the secondary transfer roller 35.

Figure 15A:
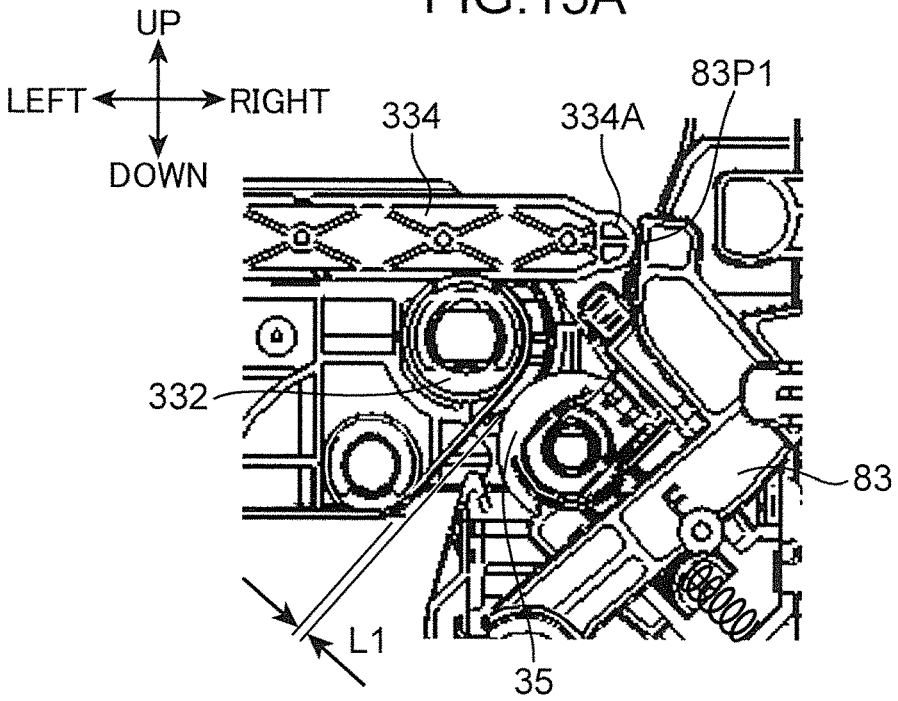
FIG. 15A is an enlarged view of surroundings of the transfer member in FIG. 13.
Figure 15B:
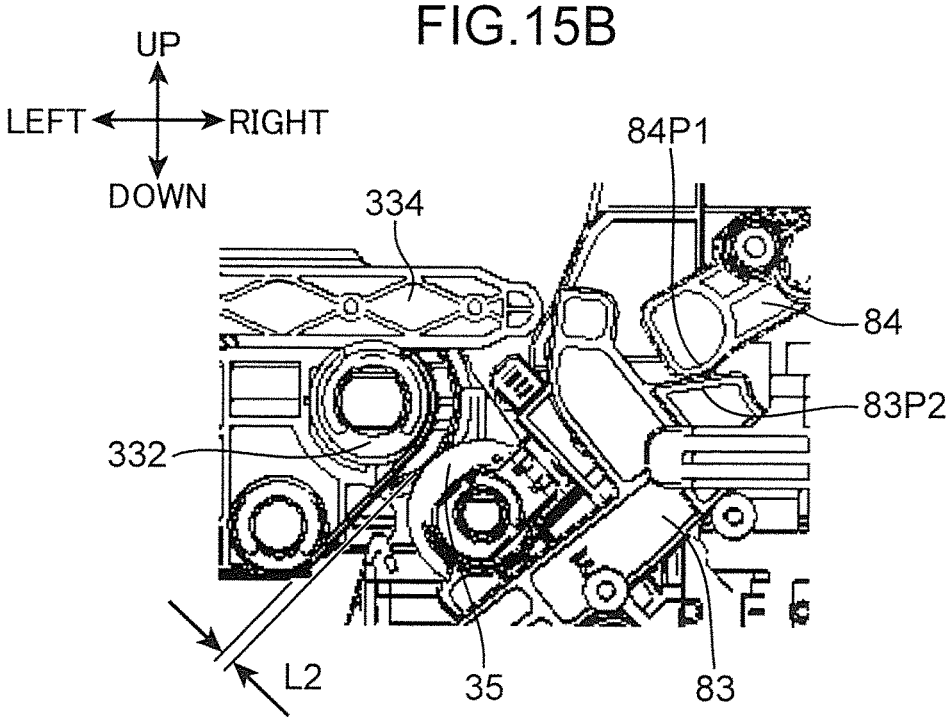
FIG. 15B is an enlarged view of the surroundings of the transfer member in FIG. 14.

FIG. 15A is an enlarged view of surroundings of the secondary transfer roller 35 in FIG. 13. FIG. 15B is an enlarged view of the surroundings of the secondary transfer roller 35 in FIG. 14. With reference to FIG. 15A, a separating distance is defined as L1, in which distance the secondary transfer roller 35 is separated from the belt driving roller 332 by pressing of the lever first pressed portion 83P1 of the separating lever 83 by the rack pressing portion 334A of the roller contact/separation mechanism 33T. On the other hand, with reference to FIG. 15B, a separating distance is defined as L2, in which distance the secondary transfer roller 35 is separated from the belt driving roller 332 by pressing of the lever second pressed portion 83P2 of the separating lever 83 by the first link pressing portion 84P1 of the cover interlocking mechanism 10Q. In the present embodiment, movable ranges of the roller contact/separation mechanism 33T, the cover interlocking mechanism 10Q, and the separating lever 83 are set in advance so as to satisfy a relationship of L1<L2.

As described above, in case of separating the secondary transfer roller 35 in conjunction with the separating operation of the primary transfer roller 325, an aim is to relieve a tension mainly of the intermediate transfer belt 331. On the other hand, in case of separating the secondary transfer roller 35 in conjunction with the opening operation of the opening/closing cover 10P and the transport unit 8, an aim is to expose the main transport path 50A to the outside of the device main body 10. Then, in particular, for preventing the opening/closing cover 10P and the transport unit 8 from opening with the secondary transfer roller 35 rubbing against the intermediate transfer belt 331, it is desirable to satisfy the relationship of L1<L2 as described above. As a result, prior to opening of the opening/closing cover 10P, the secondary transfer roller 35 can be largely separated from the belt driving roller 332 in conjunction with the operation of grasping the grasping portion 10P1.

When the roller contact/separation mechanism 33T or the cover interlocking mechanism 10Q presses the separating lever 83, the lever supporting point portion 83S functions as a fulcrum in the principle of the leverage. Additionally, the lever first pressed portion 83P1 or the lever second pressed portion 83P2 functions as a point of effort in the principle of the leverage. Then, the lever pressing portion 83P3 which presses the bush pressed portion 81P of the bush 81 and functions as a point of load in the principle of the leverage is arranged between the lever first pressed portion 83P1 and the lever second pressed portion 83P2, and the lever supporting point portion 83S. As a result, just applying a force smaller than an urging force of the pressing spring 82 to the lever first pressed portion 83P1 or to the lever second pressed portion 83P2 enables the secondary transfer roller 35 to be separated from the belt driving roller 332.

Further, in the present embodiment, since the separating lever 83 includes the lever first to-be-pressed portion 83P1 and the lever second pressed portion 83P2, a pressing force can be acted on the separating lever 83 from different directions. In particular, the separating lever 83 is arranged between the intermediate transfer unit 33 and the opening/closing cover 10P. Then, the pressing force to the lever first pressed portion 83P1 is transmitted from the side of the intermediate transfer unit 33 toward the side of the opening/closing cover 10P. Additionally, the pressing force to the lever second pressed portion 83P2 is transmitted from the side of the opening/closing cover 10P toward the side of the intermediate transfer unit 33.

In the foregoing, the image forming device 1 according to the embodiment of the present invention has been described. The above configuration enables the secondary transfer roller 35 to be separated from the intermediate transfer belt 331 in conjunction with moving operation of a plurality of moving members without increasing the number of driving sources. The present invention is not limited thereto and for example, such modified embodiments as follows can be adopted.

(1) Although the above embodiment has been described with respect to a mode in which the transport unit 8 functions as a housing which rotatably supports the secondary transfer roller 35, the present invention is not limited thereto. In other modified embodiment, separately from the transport unit 8, other housing which supports the secondary transfer roller 35 may be provided in the image forming device 1.

(2) The above embodiment has been described with respect to a mode in which the roller contact/separation mechanism 33T separates the secondary transfer roller 35 from the belt driving roller 332 in conjunction with the separating operation of the primary transfer roller 325. The present invention is not limited thereto. A roller separated by the roller contact/separation mechanism 33T may be other stretching roller in contact with the inner circumferential surface of the intermediate transfer belt 331. In this case, the roller contact/separation mechanism 33T moves the stretching roller between a first position at which the stretching roller presses the inner circumferential surface of the intermediate transfer belt 331 and a second position more separate from the inner circumferential surface of the intermediate transfer belt 331 than the first position. Further, the roller contact/separation mechanism 33T need only press the lever first pressed portion 83P1 of the separating lever 83 in conjunction with moving of the stretching roller from the first position to the second position.

The invention claimed is:

1. An image forming device, comprising:

a plurality of photosensitive drums to be rotated and to have an electrostatic latent image formed on a surface thereof;

an intermediate transfer belt arranged to be opposed to the plurality of photosensitive drums and driven to circulate, the intermediate transfer belt defining an image carrier that carries a developer image;

a transfer member configured to be in contact with the intermediate transfer belt and forms, together with the intermediate transfer belt, a transfer nip portion through which a sheet passes, and transfers the developer image onto the sheet;

a holding member that holds the transfer member;

an urging member that urges the holding member toward the intermediate transfer belt;

a pressing member capable of changing a position between a first position at which the transfer member makes contact with the image carrier by an urging force of the urging member and a second position at which the holding member is pressed against the urging force of the urging member to separate the transfer member from the image carrier;

a driving roller opposed to the transfer member and in contact with an inner circumferential surface of the intermediate transfer belt to cause the intermediate transfer belt to circulate;

a first moving member that is movable and that defines a stretching roller in contact with the inner circumferential surface of the intermediate transfer belt at a position different from the driving roller;

a second moving member that is movable;

a first interlocking mechanism that presses the pressing member in conjunction with the first moving member to change a position of the pressing member from the first position to the second position; and a second interlocking mechanism that presses the pressing member in conjunction with the second moving member to change a position of the pressing member from the first position to the second position, wherein the pressing member includes a first pressed portion that is pressed by the first interlocking mechanism, and a second pressed portion that is pressed by the second interlocking mechanism; and the first interlocking mechanism moves the stretching roller between a first position at which the stretching roller presses the inner circumferential surface of the intermediate transfer belt and a second position more separate from the inner circumferential surface of the intermediate transfer belt than the first position, and presses the first pressed portion of the pressing member in conjunction with moving of the stretching roller from the first position to the second position.

2. The image forming device according to claim 1, further comprising:

a plurality of primary transfer rollers arranged to be opposed to the plurality of photosensitive drums with the intermediate transfer belt provided therebetween for transferring the developer image to the intermediate transfer belt from the photosensitive drums, wherein the stretching roller is the plurality of primary transfer rollers, and the first interlocking mechanism moves each of the primary transfer rollers between the first position at which each of the primary transfer rollers presses the intermediate transfer belt to each of the photosensitive drums and the second position at which each of the primary transfer rollers is separated from each of the photosensitive drums.

3. The image forming device according to claim 2, wherein the first interlocking mechanism has:

a rack movable in a direction linking axes of the plurality of primary transfer rollers;

a driving mechanism that moves the rack; and a plurality of supporting members engaged with the rack and rotatably supporting the respective primary transfer rollers, the rack includes:

a first rail that regulates each of the supporting members such that each of the primary transfer rollers is arranged at the first position;

a second rail arranged at an interval from the first rail in the moving direction of the rack to regulate each of the supporting members such that each of the primary transfer rollers is arranged at the second position; and a rack pressing portion arranged in a front end portion of the rack in the moving direction and capable of pressing the pressing member, and in conjunction with moving of the rack by the driving mechanism to move each of the primary transfer rollers from the first position to the second position, the rack pressing portion presses the first pressed portion of the pressing member.

4. The image forming device according to claim 1, further comprising:

a casing;

an opening/closing cover that can be opened and closed with respect to the casing; and a grasping lever that is supported by the opening/closing cover so as to be rocked and is grasped in an opening operation of the opening/closing cover with respect to the casing, wherein the second moving member is the grasping lever, and the second interlocking mechanism presses the second pressed portion of the pressing member in conjunction with grasping and rocking of the grasping lever.

5. The image forming device according to claim 4, wherein the second interlocking mechanism includes:

a first link allowed to rotate and capable of pressing the second pressed portion of the pressing member;

a lever link movable downward in conjunction with rocking of the grasping lever; and a second link allowed to rotate by pressing by the lever link moving downward, thus rotating the first link.

6. An image forming device comprising:

an image carrier that carries a developer image;

a transfer member configured to be in contact with the image carrier and forms, together with the image carrier, a transfer nip portion through which a sheet passes, and transfers the developer image onto the sheet;

a holding member that holds the transfer member;

an urging member that urges the holding member toward the image carrier;

a pressing member capable of changing a position between a first position at which the transfer member makes contact with the image carrier by an urging force of the urging member and a second position at which the holding member is pressed against the urging force of the urging member to separate the transfer member from the image carrier;

a first moving member that is movable;

a second moving member that is movable;

a first interlocking mechanism that presses the pressing member in coniunction with the first moving member to change a position of the pressing member from the first position to the second position; and a second interlocking mechanism that presses the pressing member in conjunction with the second moving member to change a position of the pressing member from the first position to the second position, wherein the pressing member includes:

a first pressed portion that is pressed by the first interlocking mechanism;

a second pressed portion that is pressed by the second interlocking mechanism;

a supporting point portion;

and a pressing portion arranged between the supporting point portion, and the first pressed portion and the second pressed portion to press the holding member, and when the first pressed portion or the second pressed portion is pressed, the pressing member rotates around the supporting point portion, so that the pressing portion presses the holding member.

7. The image forming device according to claim 6, wherein the holding member includes:

a pivoting portion that rotatably supports the transfer member;

an urged portion that is urged by the urging member; and a pressed portion for separating that is arranged between the pivoting portion and the urged portion and is pressed by the pressing portion of the pressing member toward a direction in which the transfer member is separated from the image carrier.

8. The image forming device according to claim 6, further comprising:

a casing;

an opening/closing cover that can be opened and closed with respect to the casing; and a grasping lever that is supported by the opening/closing cover so as to be rocked and is grasped in an opening operation of the opening/closing cover with respect to the casing, wherein the second moving member is the grasping lever, and the second interlocking mechanism presses the second pressed portion of the pressing member in conjunction with grasping and rocking of the grasping lever.

9. The image forming device according to claim 8, wherein the second interlocking mechanism includes:

a first link allowed to rotate and capable of pressing the second pressed portion of the pressing member;

a lever link movable downward in conjunction with rocking of the grasping lever; and a second link allowed to rotate by pressing by the lever link moving downward, thus rotating the first link.

* * * * *